US007010879B2

(12) United States Patent
Olson

(10) Patent No.: US 7,010,879 B2
(45) Date of Patent: Mar. 14, 2006

(54) TRIGGER ASSEMBLIES FOR GRENADE LAUNCHER ATTACHMENTS TO GAS-OPERATED RIFLES

(75) Inventor: Douglas D. Olson, Vero Beach, FL (US)

(73) Assignee: Knight's Armament Company, Titusville, FL (US)

( * ) Notice: Subject to any disclaimer, the term of this patent is extended or adjusted under 35 U.S.C. 154(b) by 227 days.

(21) Appl. No.: 10/741,963

(22) Filed: Dec. 22, 2003

(65) Prior Publication Data

US 2005/0132628 A1 Jun. 23, 2005

(51) Int. Cl.
*F41C 27/06* (2006.01)

(52) U.S. Cl. ..... 42/105; 42/69.01; 42/69.03

(58) Field of Classification Search ..... 42/105, 42/69.01, 69.03; 124/31
See application file for complete search history.

(56) References Cited

U.S. PATENT DOCUMENTS 580,935 A * 4/1897 Ehbets ..... 89/144
2,433,309 A * 12/1947 Van Karner ..... 42/69.01
2,465,931 A * 3/1949 Roderick ..... 89/1.3
2,480,328 A * 8/1949 Johnston ..... 89/1.705
2,499,379 A * 3/1950 Garrett ..... 42/105
3,641,691 A * 2/1972 Ellis et al. ..... 42/105
4,553,347 A * 11/1985 Jackson ..... 42/69.01
4,689,912 A * 9/1987 Gillum ..... 42/105
5,146,705 A * 9/1992 Martin ..... 42/70.06
5,235,771 A * 8/1993 Sokol et al. ..... 42/105
5,854,440 A * 12/1998 Canaday et al. ..... 89/28.05
6,142,058 A * 11/2000 Mayville et al. ..... 89/126

* cited by examiner

*Primary Examiner*—M. Clement
(74) *Attorney, Agent, or Firm*—Brian S. Steinberger; Law Offices of Brian S. Steinberger, P.A.

(57) ABSTRACT

Grenade launchers for attachment to gas-operated service rifles and carbines such as the M16 and M4 are improved by providing them with a trigger assembly that enables the shooter to deliver repeated hammer strikes to the primer of the loaded grenade without having to open the breach to reset the hammer and signals final aim indication via added trigger pull force.

3 Claims, 10 Drawing Sheets

TRIGGER ASSEMBLIES FOR GRENADE LAUNCHER ATTACHMENTS TO GAS-OPERATED RIFLES

BACKGROUND OF THE INVENTION

1. Field of the Invention

This invention relates broadly to grenade launcher attachments for gas-operated automatic and semi-automatic rifles. More particularly, it concerns improved trigger assemblies for the grenade launcher attachments.

2. Description of the Prior Art

Grenade launchers for attachment to gas-operated service rifles and carbines such as the M16 and M4 are known firearms devices, e.g. see U.S. Pat. Nos. 3,641,145 and 6,281,145. A need exists for such launchers to have a trigger assembly that allows the operator to deliver repeated hammer strikes to the primer of the loaded cartridge without having to open the breach to reset the hammer. The state of the art in grenade launchers is the M203 that has a firing mechanism that is cocked when the weapon is locked shut. It can only be released to strike the primer of the loaded cartridge one time without opening the breach and closing it again thereby resetting the hammer.

There have been many double-acting trigger assemblies for firearms previously designed that allow trigger pull to cock and trip the hammer repeatedly, e.g., see U.S. Pat. Nos. 3,965,603; 4,285,152; 5,160,795 and 5,400,537.

It has also been known to construct trigger assemblies for firearms wherein an increased pressure is required at the end of the trigger stroke to provide a clear tactile indication to the shooter that the hammer is in pending release to fire the weapon, e.g. see U.S. Pat. Nos. 4,974,356 and 6,571,502.

The present invention provides further improvements in the construction of grenade launchers for attachment to rifles and their trigger assemblies.

OBJECTS

A principal object of the invention is the provision of improvements in construction of grenade launchers for attachment to service rifles, including carbines, such as the M16A2 and M4.

Further objects include:

1. Improvements in the construction of grenade launchers for attachment to rifles by providing added signal trigger pull force mechanically within the trigger assembly via its mechanical design.

2. Improvements in the construction of grenade launchers for attachment to rifles comprising a trigger assembly that allows the operator to deliver repeated hammer strikes to the primer of the loaded cartridge without having to open the breach to reset the hammer.

3. The provision of rifle attached grenade launchers that are easier to operate then their predecessors and have improved probability of hitting a target upon firing.

4. The provision of improved trigger assemblies for rifle attached grenade launchers that help shorten the length and reduce the weight of the grenade launchers.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The stated objects are accomplished in accordance with the invention by the provision of improved grenade launchers that basically include a receiver structured for attachment to a service firearm, a barrel depending from the receiver, a breech at the rear of the barrel and a hand-grip enclosing at least a portion of the barrel.

The improvement in the new grenade launchers is in improved trigger assemblies comprising a frame depending from the receiver proximal of the grenade launcher breech and defined by a forward vertical portion, a rearward vertical portion and a central cavity therebetween. Left and right cover-plates are removeably fitted to the frame.

A trigger guard depends from the frame and is fitted with a trigger pivot.

A trigger defined by an upper end and a lower end is pivoted at its lower end on the trigger pivot and configured at its upper end with a cocking notch and a ledge that extends integrally and proximally from the cocking notch.

A trigger spring is fitted between the trigger and the frame to bias the upper end of the trigger toward the forward vertical portion of the frame.

A hammer defined by an upper end and a lower end has the upper end pivoted to the frame and there is a lever-arm extending integrally and upwardly from the hammer's upper end. Further, the lower end of the hammer is configured with a vertical recess.

A spring plunger is carried in a bore in the receiver to engage the lever arm on the hammer to bias the lower end of the hammer around the hammer pivot toward the breech of the grenade launcher barrel.

A critical element of the new trigger assemblies is a link of triangular shape defined by a major leg, a first minor leg, a second minor leg and a link nose at the junction of the major and first minor legs. This link is pivoted to the hammer within its vertical recess mentioned above for limited rotation of the link in a vertical plane.

A link spring is carried on the lower end of the hammer to urge the link nose downward by rotation of the link.

Finally, a firing pin is reciprocally carried in the forward vertical portion of the frame to be impacted for firing of the grenade launcher by the lower end of the hammer.

Advantageously, the new grenade launchers include a trigger spring protected in a two-part telescoping capsule with its first part fitted into the trigger guard and its second part fitted into the hammer. Also, a set screw is carried by the frame to limit the forward travel of the trigger.

BRIEF DESCRIPTION OF THE DRAWINGS

A more complete understanding of the invention can be obtained by reference to the accompanying drawings in which.

DESCRIPTION OF THE PREFERRED EMBODIMENTS

In the attached drawings, the numerals with an arrowhead lead-lines refer to major structural units, numerals with plain lead-lines refer to specific parts and in all figures, the same numerals specify identical elements.

Figure 1:
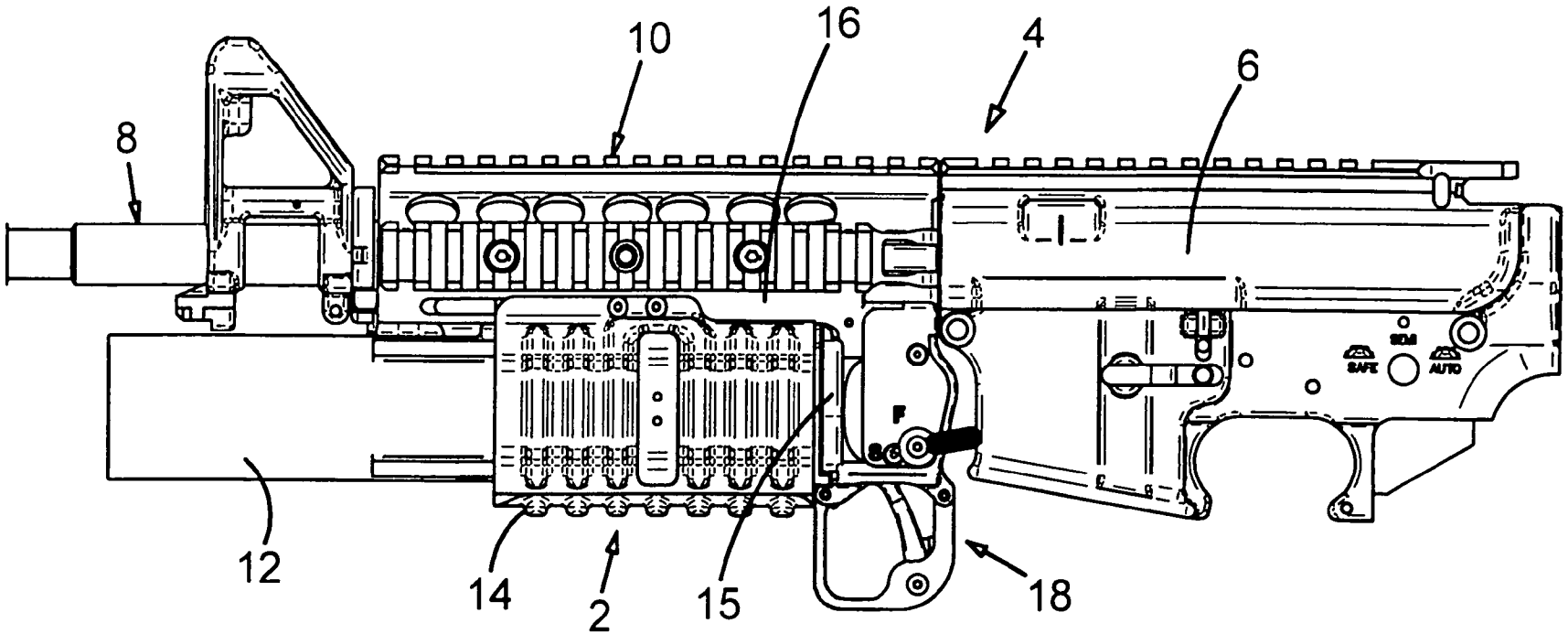
FIG. 1 is a left side elevation of a grenade launcher of the invention attached to a gas-operated carbine.

Referring initially in detail to FIG. 1, the grenade launcher 2 constructed in accordance with the invention is attached to the gas-operated rifle 4 comprising rifle receiver assembly 6, rifle barrel 8 and rifle hand-guard 10.

The grenade launcher 2 generally comprises barrel 12, hand-grip 14, breech 15, receiver 16 and trigger assembly 18. The receiver 16 is attached to and depends from the rifle hand-guard 10. For loading grenades and unloading spent casings (not shown), the barrel 12, hand-grip 14 and breech 15 pivot to the left side away from the receiver 16 and trigger assembly 18.

Figure 2:
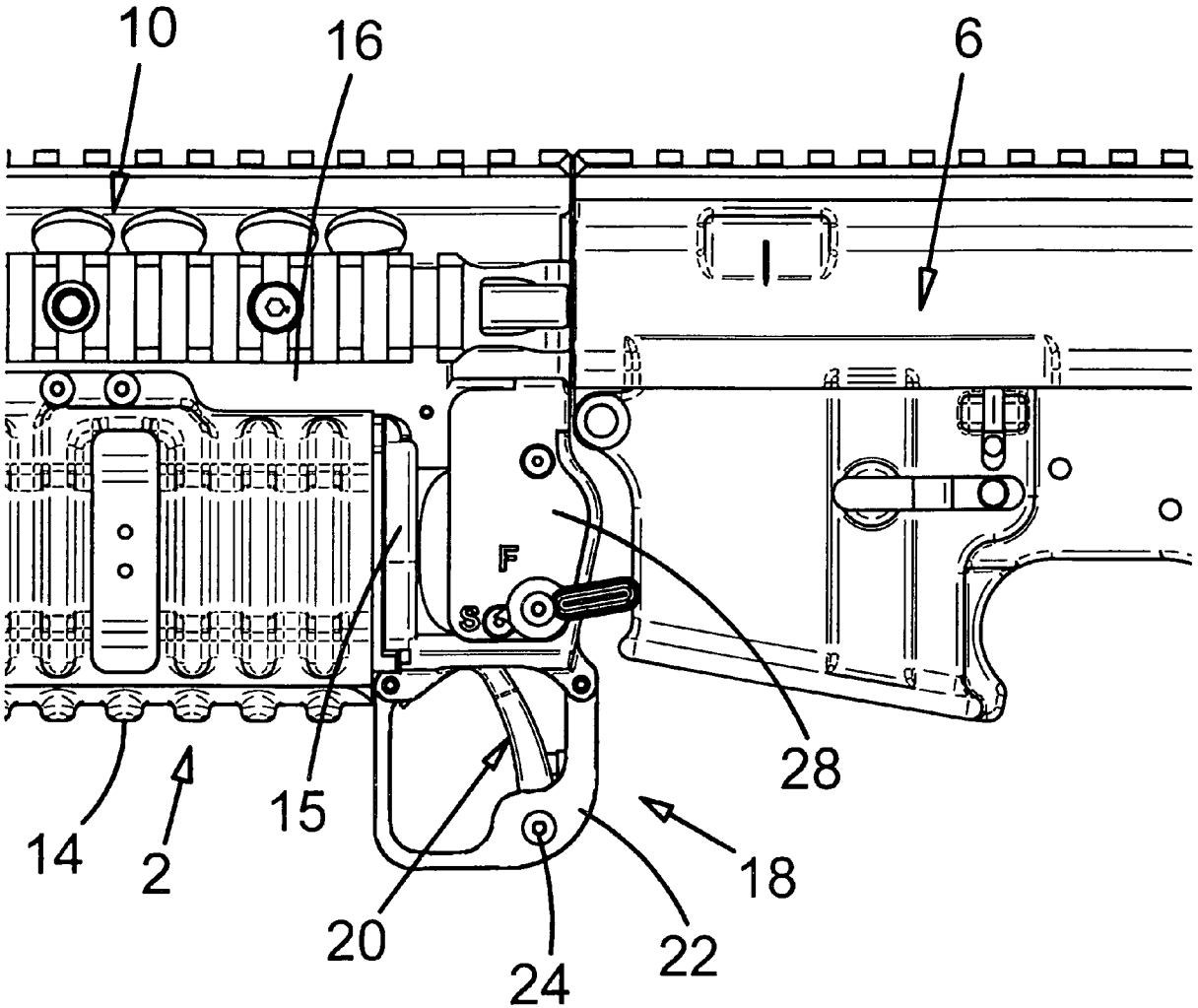
FIG. 2 is a closer left side elevational view of the grenade launcher of FIG. 1 focused on the trigger assembly.

Referring to FIG. 2, the trigger assembly 18 includes the trigger 20, trigger guard 22, trigger pivot 24 carried by the trigger guard 22, frame 26 from which the trigger guard 22 depends, a pair of left and right cover-plates 28 (right not shown) releasably fixed to the receiver 16.

Figure 3:
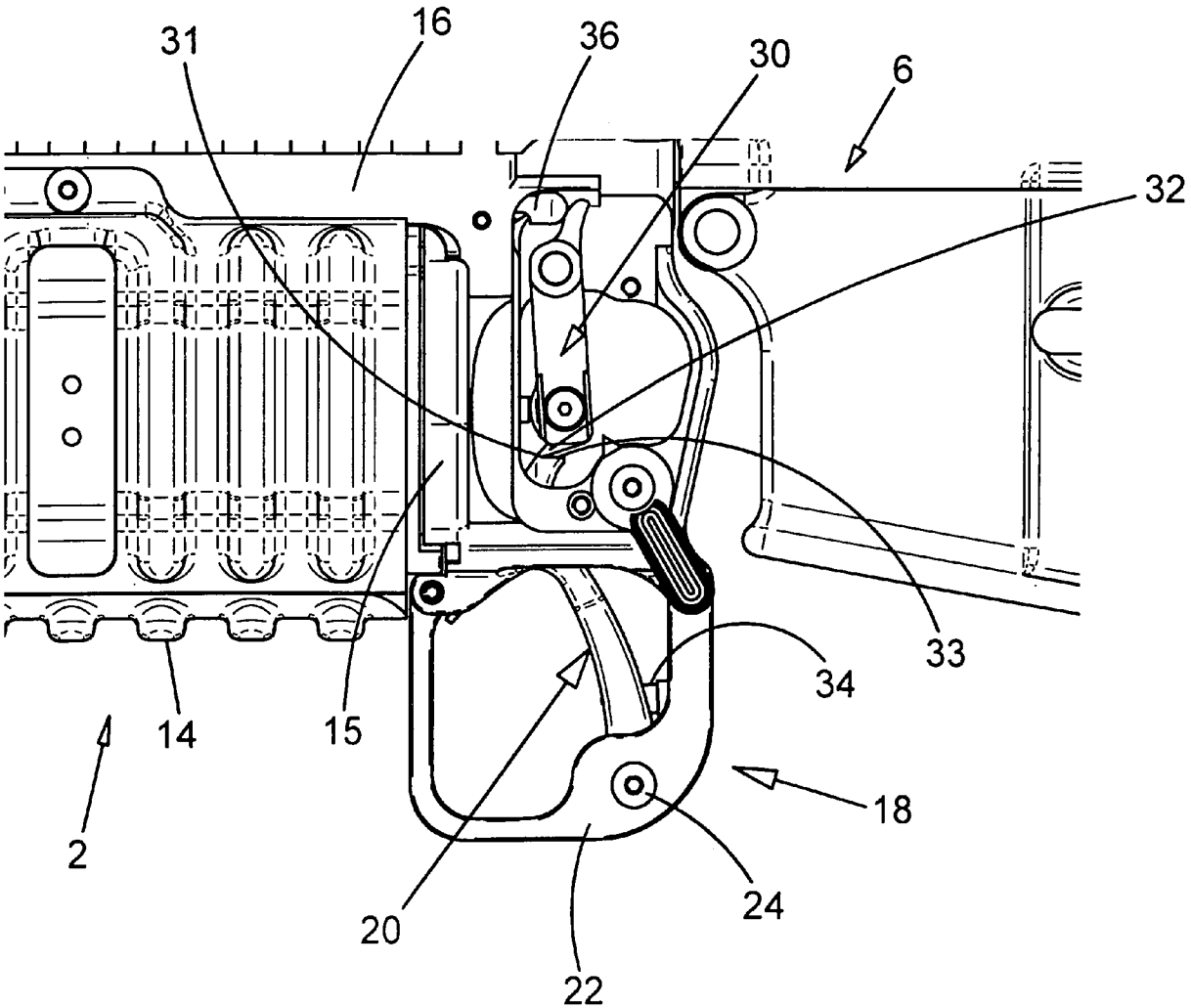
FIG. 3 is an even closer left side elevational view of the grenade launcher of FIG. 1 in which the cover plates have been removed from the trigger assembly.

Referring to FIG. 3 shown without cover-plate 28, the trigger assembly 18 further includes hammer 30, cocking notch 31 in front of ledge 33 at the top of trigger 20, link 32, trigger spring 34 and hammer spring plunger 36.

Figure 4:
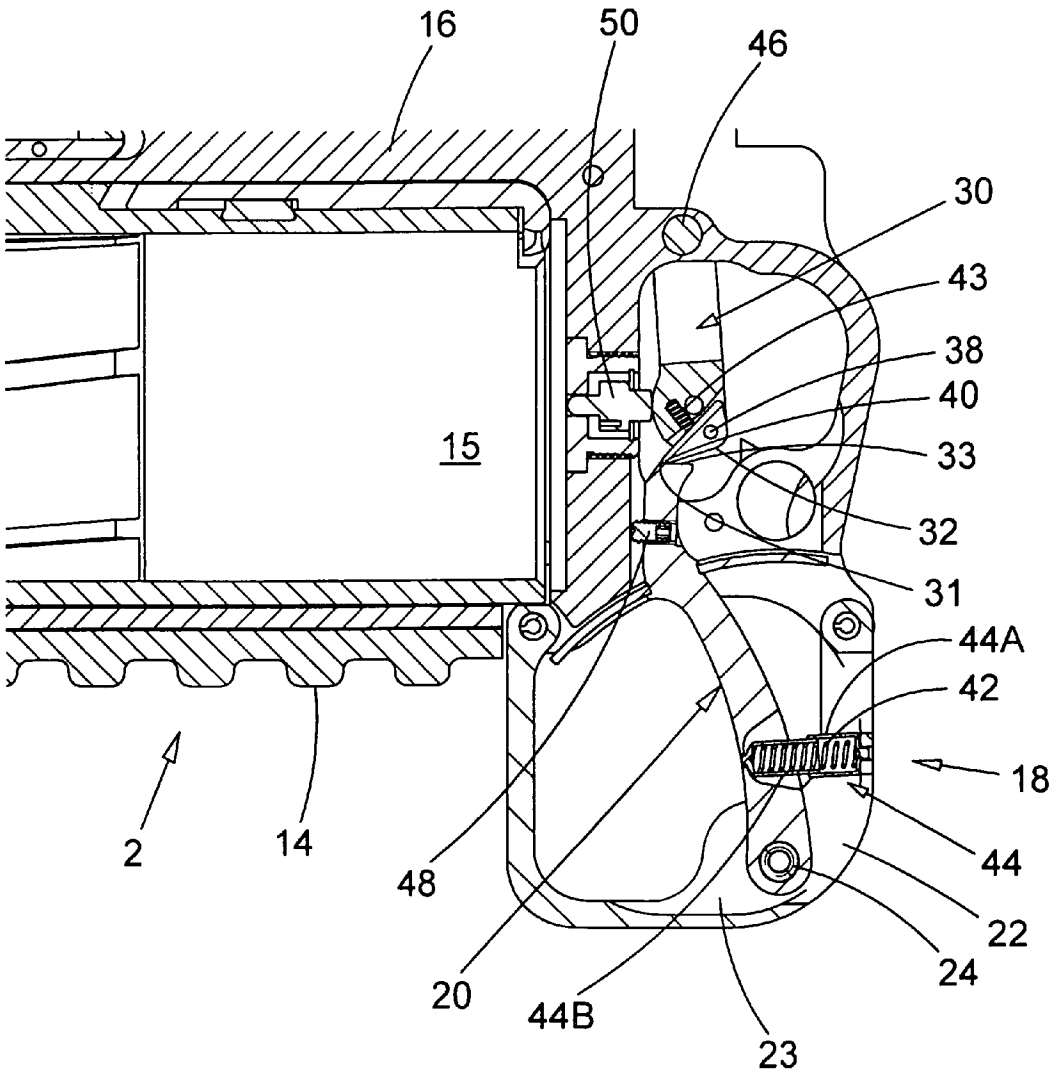
FIG. 4 is a left side sectional view taken along the centerline of the grenade launcher. In this and the remaining figures, there is no showing of parts of the rifle to which the grenade launcher is attached.

Referring to FIG. 4, the trigger 20 has pulled link 32 about the link pivot pin 38 slightly to the rear with the link nose 40 settled into the cocking notch 31. Also shown are trigger spring 42, link spring 43, hammer pivot pin 46, trigger travel adjustment set screw 48 and firing pin 50. The trigger spring 42 is protected in a two-part telescoping capsule 44 with its first part 44A fitted into the trigger guard 22 and its second part 44B is fitted into the trigger 20.

The set screw 48 limits the forward travel of the trigger 20 to keep link 32 from dropping down behind the ledge 33 on top of the trigger 20 which is the surface that engages the link 32 and causes the hammer 30 to retract.

Figure 5:
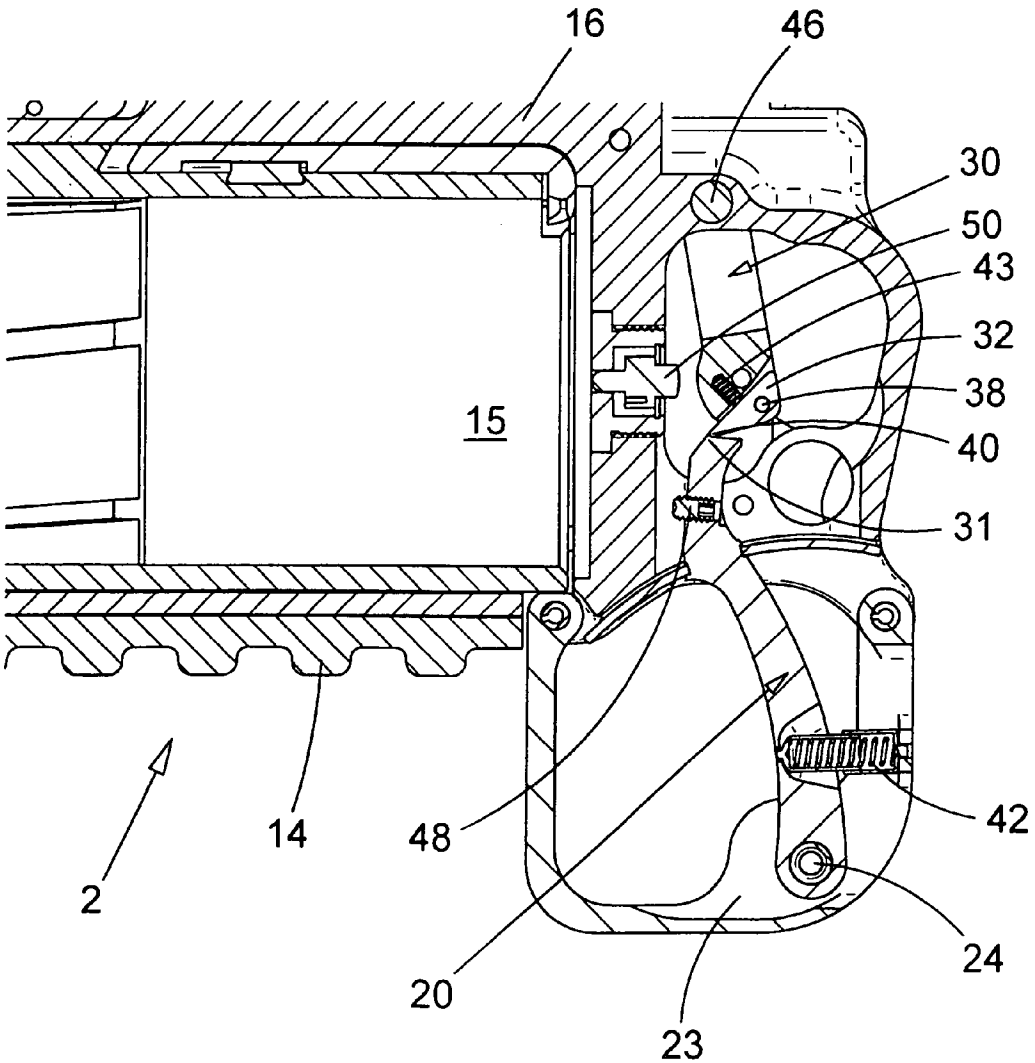
FIG. 5 is a left side sectional view with the trigger pulled slightly to the rear.

Referring to FIG. 5, this shows the trigger pulled further to the rear so the hammer 30 disengages the firing pin 50 while the link 32 pivots as necessary to keep link nose 40 in contact with the cocking notch 31 of trigger 20.

Figure 6:
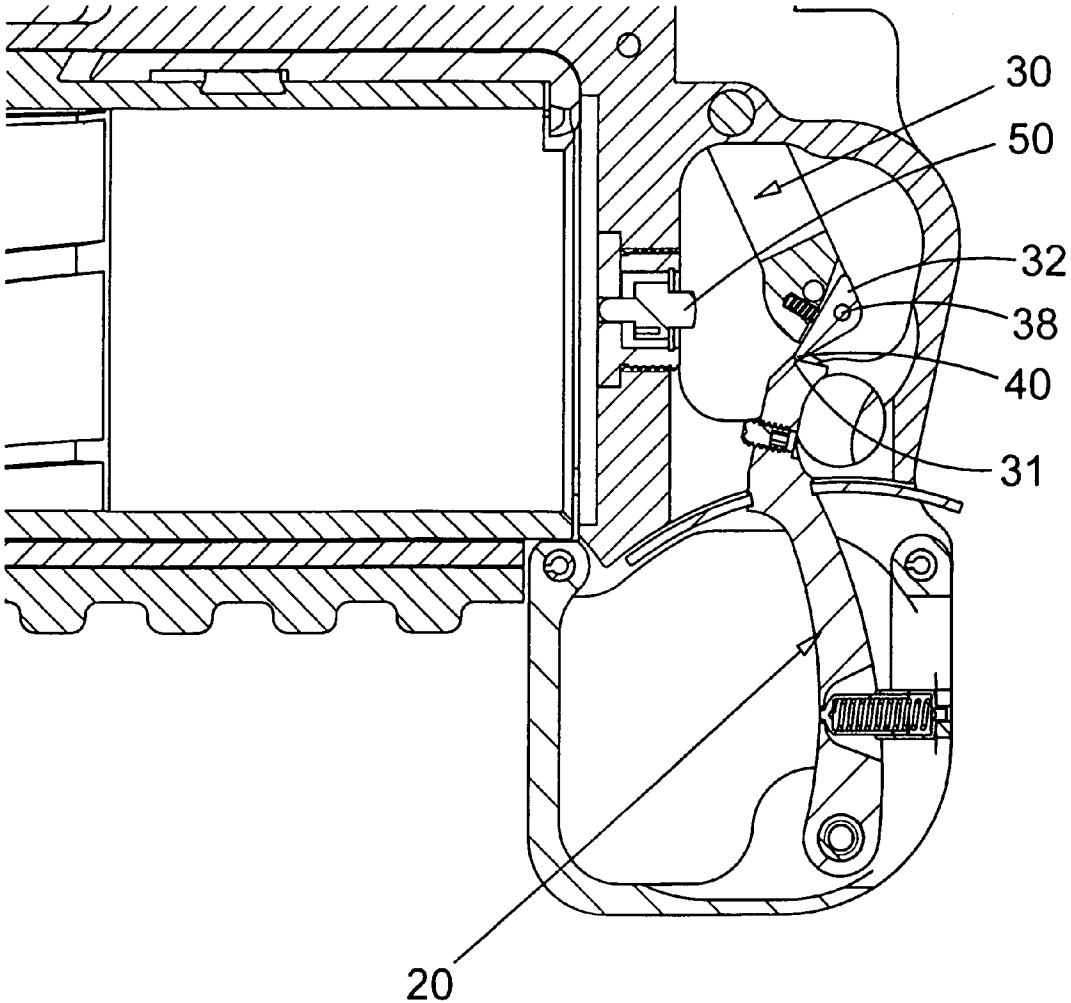
FIG. 6 is a left side sectional view similar to FIG. 5 that shows the trigger traveling to the rear with the link pivoting as necessary to keep its front rounded nose into the mating surface on the trigger.

FIG. 6 shows another intermediate position of travel of trigger 20 and the position of link 32 as the trigger 20 is pulled further rearward.

Figure 7:
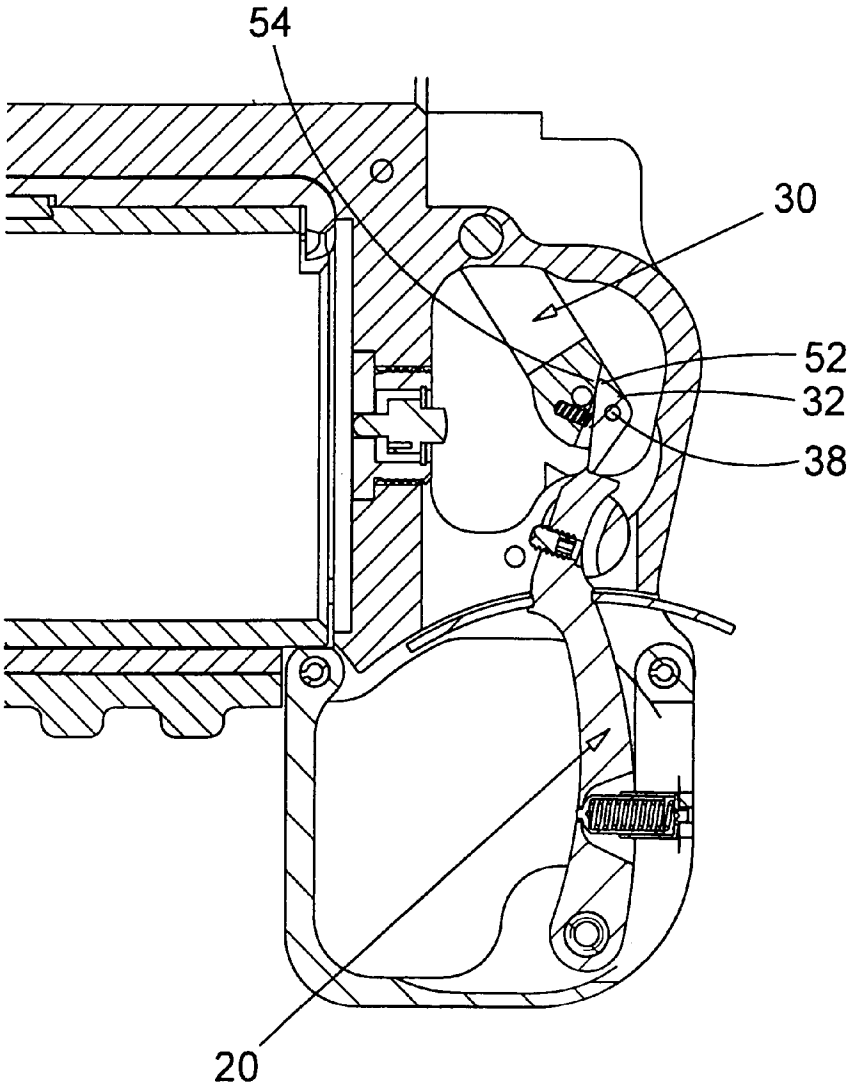
FIG. 7 shows the end of the first stage of the trigger travel wherein the link has rotated until the surface above and behind its pivot point has contacted a ledge in the hammer.

FIG. 7 shows the end of the first-stage of rearward travel of trigger 20 wherein the link travel limit surface 52 comes into contact with the stop ledge 54 on hammer 30 as link 32 rotates about link pivot pin 38.

Figure 8:
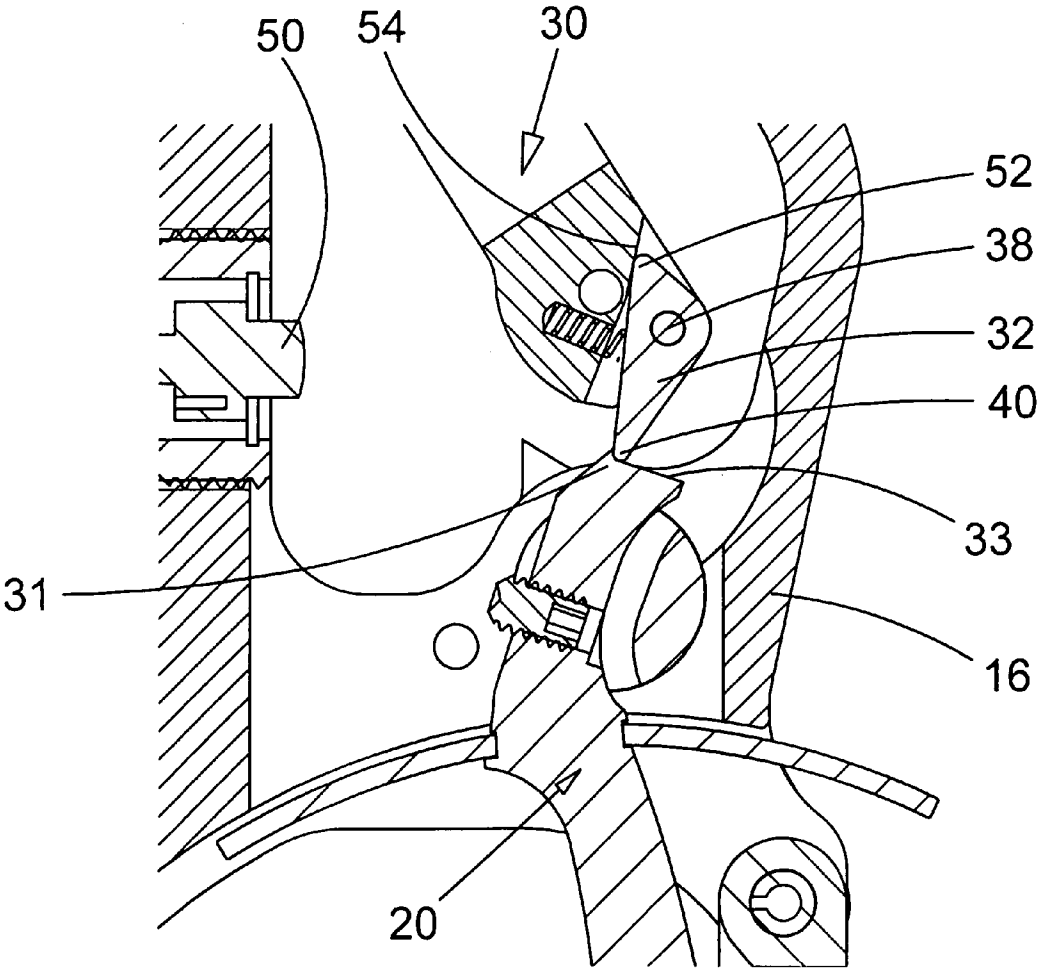
FIG. 8 is a close-up view of the trigger position in FIG. 7.

FIG. 8 shows a close-up view of end of the first-stage of rearward travel of trigger 20 as shown in FIG. 7.

Figure 9:
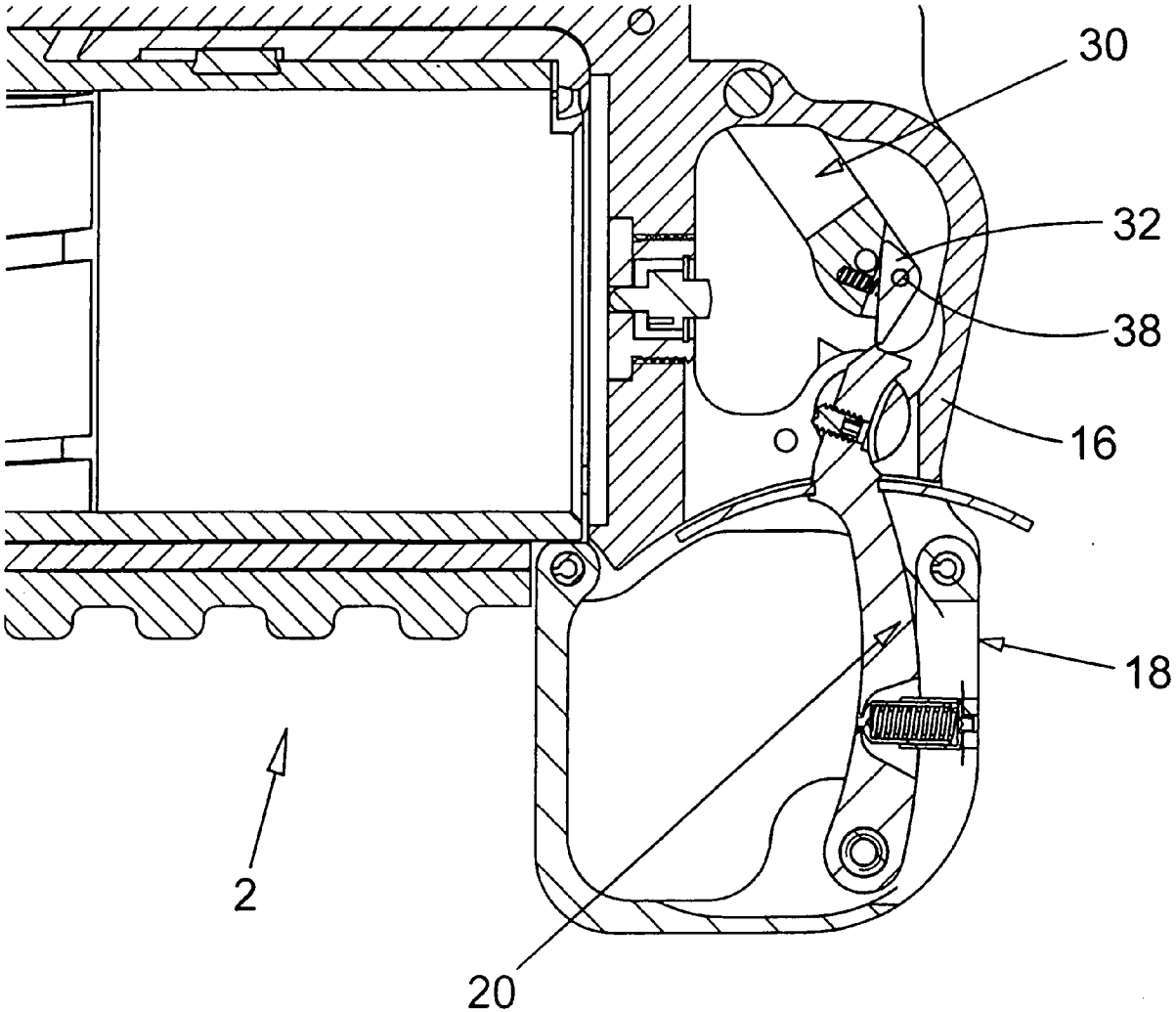
FIG. 9, compared to FIG. 7, shows the trigger rotation position thru the second-stage of the trigger travel.
Figure 10:
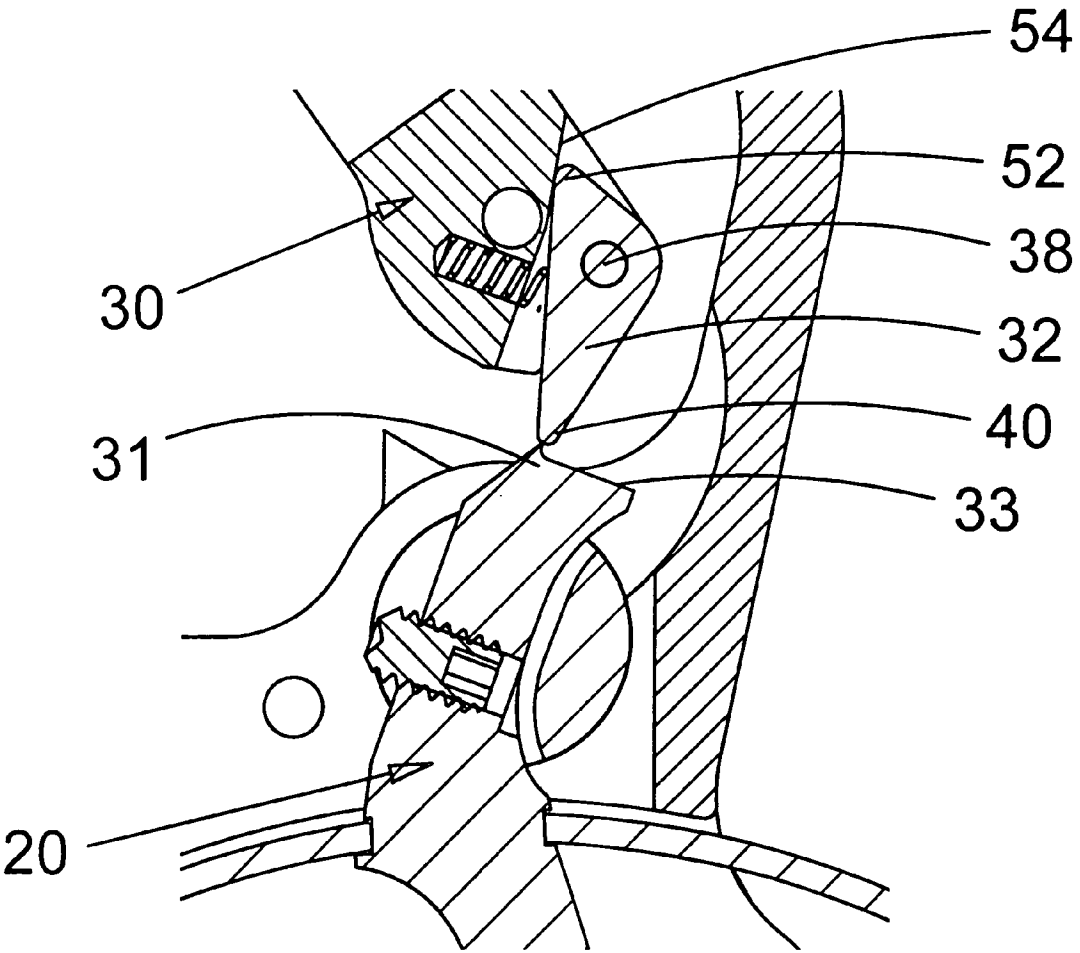
FIG. 10 is an enlarged, close-up view of the trigger assemply in the position of FIG. 9.

FIGS. 9 & 10 show the second-stage of rearward travel of trigger 20. Now that the link 32 can no longer rotate relative to the hammer 30, the continued rearward travel of the trigger 20 causes the link nose 40 to slide up the cocking notch 31 of the trigger 20. When the link nose 40 finally clears the cocking notch 31, the hammer 30 is released to travel forward powered by springs that have been compressed in hammer spring plunger 36 during the first-stage of trigger travel.

In preferred embodiments of the invention, the force required to pull the trigger to the end of the first stage is approximately 5 pounds. The load thereafter immediately increases to approximately 8 pounds just before the hammer is released. This three-pound difference provides a clear tactile indication to the shooter that the hammer is in pending release so the final aim can be made just before the weapon is fired. Trigger assemblies of the invention thus provide the gunner with improved hit probability over those that do not provide the tactile feel of impending release.

One of the major features of trigger assembly 18 is that it accomplishes its task within a very small front to back length of the weapon. This enables moving the base of the cartridge to the rear by approximately 1.5 inches relative to the current M203 grenade launcher. Moving the cartridge to the rear makes the weapon easier to operate because the shooter doesn't have to reach so far forward to load it, but also reduction in the weight of the launcher by ⅓ and to move its center of mass to the rear as well. The new compact trigger assembly in accordance with the invention has made this possible.

What is claimed is:

1. In a grenade launcher including a receiver structured for attachment to a service firearm, a barrel depending from said receiver, a breech at the rear of said barrel and a hand-grip enclosing at least a portion of said barrel, the improvement characterized by a trigger assembly comprising in combination:

a frame depending from said receiver proximal of said breech and defined by a forward vertical portion, a rearward vertical portion and a central cavity therebetween, left and right cover-plates removeably fitted to said frame, a trigger guard depending from said frame and fitted with a trigger pivot, a trigger defined by an upper end and a lower end with said lower end pivoted on said trigger pivot and configured at its upper end with a cocking notch and a ledge that extends integrally and proximally from said cocking notch, a trigger spring fitted between said trigger and said frame to bias said upper end of said trigger toward said forward vertical portion of said frame, a hammer defined by an upper end and a lower end, said upper end being pivoted to said frame with a lever-arm extending integrally and upwardly thereof and said lower end being configured with a vertical recess, a spring plunger carried in a bore in said receiver to engage said lever arm to bias said lower end of said hammer toward said breech, a link of triangular shape defined by a major leg, a first minor leg, a second minor leg and a link nose at the junction of said major and first minor legs, said link being pivoted to said hammer within said vertical recess for limited rotation in a vertical plane, a link spring carried on said lower end of said hammer to urge said link nose downward by rotation of said link, and a firing pin reciprocally carried in said forward vertical portion of said frame to be impacted for firing of said grenade launcher by said lower end of said hammer.

2. A grenade launcher in accordance with claim 1 comprising a trigger spring covered by a telescopic capsule that has a first end fitted into said trigger guard and a second end fitted into said trigger.

3. A grenade launcher in accordance with claim 1 comprising a set screw carried by said frame to limit the forward travel of said trigger.

* * * * *